US007037169B2

(12) United States Patent
Benedek et al.

(10) Patent No.: US 7,037,169 B2
(45) Date of Patent: May 2, 2006

(54) ROTATING TOY WITH ROTATION MEASUREMENT MEANS

(76) Inventors: Gyora Mihaly Pal Benedek, 54 ABA Hushi, Haifa (IL); Yehiel Avraham Olti, 5/A Mishol Erez, Karmiel (IL); Shai Seger, 22 Mizpe, Haifa (IL); Robert Bruce Fuhrer, 7 Whippoorwill Close, Chappaqua, NY (US) 10514

( * ) Notice: Subject to any disclaimer, the term of this patent is extended or adjusted under 35 U.S.C. 154(b) by 0 days.

(21) Appl. No.: 10/700,533

(22) Filed: Nov. 5, 2003

(65) Prior Publication Data

US 2005/0277360 A1 Dec. 15, 2005

Related U.S. Application Data

(60) Provisional application No. 60/437,176, filed on Jan. 2, 2003.

(51) Int. Cl.
*A63H 1/24* (2006.01)

(52) U.S. Cl. ..... 446/242; 446/259

(58) Field of Classification Search ..... 446/259, 446/242, 233, 175, 454, 456
See application file for complete search history.

(56) References Cited

U.S. PATENT DOCUMENTS

| | | | | |
|---|---|---|---|---|
| RE8,708 | E | 5/1879 | Sibley et al. | |
| D31,654 | S | 10/1899 | Poteet | |
| D63,891 | S | 2/1924 | Flauder | |
| 1,503,006 | A | 7/1924 | Rause | |
| 3,783,550 | A * | 1/1974 | Andrews | 446/484 |
| 4,200,283 | A * | 4/1980 | Andrews et al. | 446/259 |
| 4,470,044 | A | 9/1984 | Bell | |
| 5,007,877 | A * | 4/1991 | Watson | 446/242 |
| 5,135,425 | A * | 8/1992 | Andrews et al. | 446/133 |
| 5,190,491 | A * | 3/1993 | Connelly | 446/242 |
| 5,406,300 | A | 4/1995 | Tokimoto et al. | |
| 5,791,966 | A | 8/1998 | Capps et al. | |
| 6,270,391 | B1 | 8/2001 | Emilsson | |
| 6,325,690 | B1 * | 12/2001 | Nelson | 446/242 |
| 6,623,405 | B1 * | 9/2003 | Chuang et al. | 482/44 |

FOREIGN PATENT DOCUMENTS

| | | | |
|---|---|---|---|
| GB | 2388329 | A * | 11/2003 |
| KR | 2003059785 | A * | 7/2003 |

* cited by examiner

*Primary Examiner*—John A. Ricci
(74) *Attorney, Agent, or Firm*—Mark M. Friedman

(57) ABSTRACT

A rotating toy is provided, the rotating toy having a rotation data measuring means. Data, such as rate of rotation, concerning the rotation of the toy is used to implement amusing games. Various embodiments of the toy of the present invention include a top provided with a synchronized display, a top provided with a transceiver and a top that "walks".

34 Claims, 11 Drawing Sheets

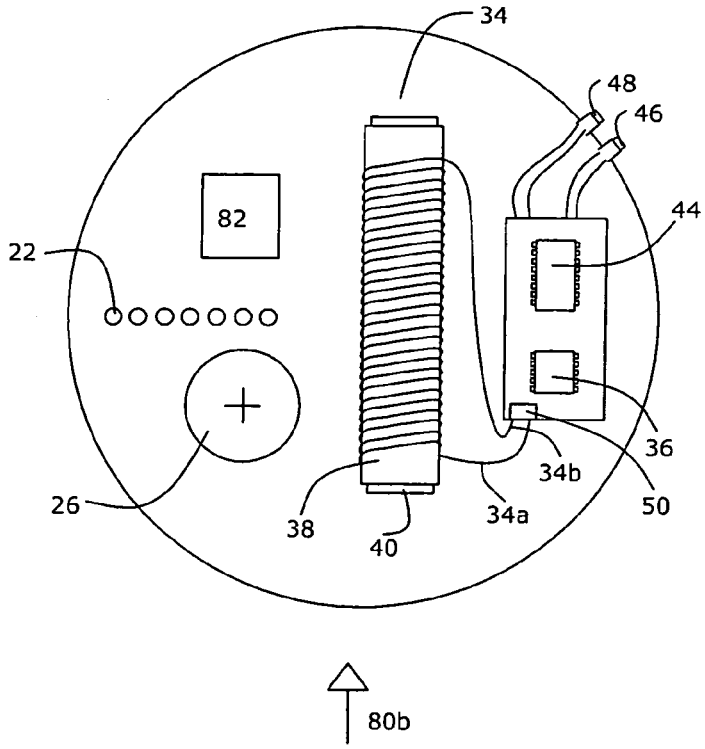
Fig. 8
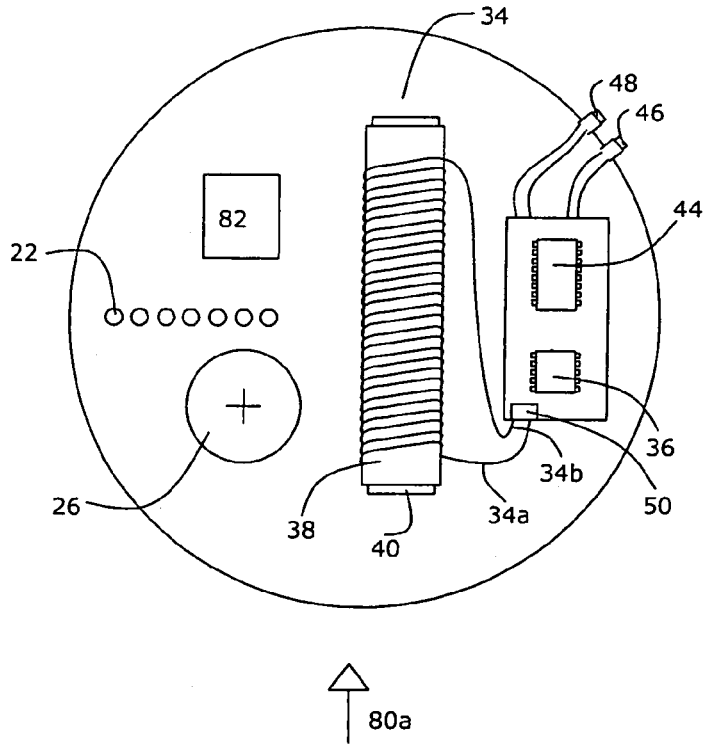

ROTATING TOY WITH ROTATION MEASUREMENT MEANS

This appln claims the benefit of 60/437,176 filed on Jan. 2, 2003.

FIELD AND BACKGROUND OF THE INVENTION

The present invention relates to the fields of toys, and specifically to a rotating toy equipped with a means to measure rotation data. The rate of rotation and/or other data related to rotation of the rotating toy measured are used to implement many entertaining games. Playing with a toy of the present inventions supplies hours of fun for friends and family alike.

Rotating toys are popular in many cultures. Well known rotating toys including such favorites as tops (tsa-lin, koma), yo-yos, boomerangs, flying disks (such as Frisbees®), flying rings, ko-en-gen (diabolo), balls and roulette wheels. Spinning toys are used, for example, for playing catch, acrobatics, studying of holy scriptures (e.g. the Dreidel), gambling (roulette, teetotum tops), or even weapons (the yo-yo, boomerang, Oddjob's hat from the film Goldfinger (MGM/UA Home Entertainment Inc.)). Although there are many variations of rotating toys, it is likely that the general popularity of these toys arises from the inherently fascinating motion together with the magical stability which the gyroscopic motion gives a rotating toy.

Persons of skill in the art have devoted much effort in the improvement of spinning toys, see for example U.S. D31,654, U.S. RE8,708 or U.S. Pat. No. 63,891. More recently, advances in materials technology and electronics have lead to the integration of special features into rotating toys, especially illuminated rotating toys (U.S. Pat. No. 1,503,006) or toys that play music when rotating.

U.S. Pat. No. 5,791,966 teaches a very exciting improvement to rotating toys, specifically for tops and yo-yos, based on utilizing the persistence of vision effect. According to U.S. Pat. No. 5,791,966 a display mechanism comprising an array of lights rotating with a toy and a processor for differentially actuating the individual lights according to a stored pattern. When the toy rotates at a rate that matches the clocking speed of the stored pattern, a two-dimensional image (such as a message or figure) becomes apparent due to the effect of persistence of vision.

The inventors of U.S. Pat. No. 5,791,966 discuss at length the fact that the image is apparent only for brief periods when the rate of rotation of the toy and the pattern clocking speed match. To overcome this shortcoming, U.S. Pat. No. 5,791,966 suggests the use of a synchronization mechanism so that the image is apparent over a wide range of rates of rotation. Seemingly synchronization is simple and obvious to one skilled in the art. Few things are further from the truth as is evidenced by the failure of the inventors of U.S. Pat. No. 5,791,966 to provide an implementable solution for this problem.

In U.S. Pat. No. 5,791,966 is suggested a mechanism to provide an external non-rotating reference to which the display timing is synchronized. It is stated that such a mechanism can be optical, magnetic or involve other means. The only magnetic mechanism taught is the use of a static magnetic to activate a metal switch that is fixed to a rotating hubcap. Such a mechanism is susceptible to dirt, vibrations and minor misalignments. For such a metal switch to be effective it would need to be quite massive, in which case the switch would close during rotation due to centrifugal force.

Worse, the reaction of such a switch will not keep up with the rotation speed. The only optical mechanism taught involves the use of a rotating optical sensor (e.g. a LED/photoresistor pair) to optically detect a non-rotating external reference point.

The solutions for gaining data associated with rotation of a spinning toy require that the spinning toy be associated with a non-rotating reference. This significantly limits the fun from a synchronized rotating toy according to the teachings of U.S. Pat. No. 5,701,966. These ineffective solutions demonstrate that a method for measuring data associated with the rotation of a toy is not obvious even to one skilled in the art.

It would be highly advantageous to have a rotating toy that overcomes the shortcomings of the prior-art rotating toys.

SUMMARY OF THE INVENTION

The above and other objectives are achieved by the present invention.

There is provided according to the teachings of the present invention a rotating device (preferably a toy or part of a toy) comprising: a) a rotatable body, b) inside the rotatable body, a rotation data measuring means; and c) a control unit, the control unit configured to receive data relating to rotation of the body from the rotation data measuring means. Such data can include, for example, acceleration, velocity, rate of rotation and the like.

The body of the device is substantially a toy or part of a toy and includes but is not limited to such toys as tops, flying disks (such as Frisbees®), flying rings, boomerangs, roulette wheels, yo-yos, balls and ko-en-gen.

According to a feature of the present invention all components of the rotation data measuring means are associated with the rotatable body. In such a way no external reference is necessary for the device to operate.

According to a feature of the present invention, the device further comprises at least one switch, the at least one switch configured to transfer commands to the control unit. Using such a switch or switches a user can select modes and functions of the device.

According to another feature of the present invention, a device of the present invention is not equipped with a mechanical switch. Rather, the control unit is generally in a low-energy use "stand-by" mode. The control unit exits the "stand-by" mode upon receiving a signal from the rotation data measuring means and functions further as described herein.

According to a feature of the present invention the rotation data measuring means is configured to produce a substantially sinusoidal output signal having a frequency related to rotation of the body.

According to one embodiment of the present invention, the rotation data measuring means comprises a means for detecting a magnetic field, for example the Earth's magentic field. In some such embodiments, the control unit is then configured to determine a true direction (e.g. North) from the data received from the rotation measuring means.

According to a feature of the present invention, the rotation data measuring means comprise an induction coil.

According to a further feature of the present invention, the device of the present invention further comprises a signal-amplifying means configured to input the sinusoidal signal from the rotation data measuring mean, to amplify the sinusiodal signal so as to convert the signal to a substantially rectangular wave signal having a frequency substantially identical to the frequency of the sinusoidal signal, and to output the substantially rectangular wave signal to the control unit.

According to one preferred embodiment of the present invention the device further comprises: d) a display means disposed along at least a portion of the body; e) a display control means for controlling the display of images on the display means; and f) a clock means coupled to the display control means for refreshing the display of images on the display means at a clocking rate, wherein the clocking rate is dependent on the rotation data. According to a feature of the present invention, the display mechanism comprises a plurality of independently activatable and deactivatable light sources.

According to a feature of the present invention, the control unit is configured to calculate a number of revolutions that the rotatable body has performed and display the number of revolutions using the display mechanism.

According to further feature of the present invention, the control unit is configured to calculate a rate of rotation of the rotatable body and display the rate of rotation using the display mechanism.

According to an additional embodiment of the present invention, the device further comprises a wireless data receiver, the receiver configured to receive data from a remote location and pass the data to the control unit.

According to an additional embodiment of the present invention, the device further comprises a wireless data transceiver, the transceiver configured to receive rotation data from the control unit and transmit the rotation data to a remote location and the transceiver is further configured to receive data from a remote location and pass the data to the control unit.

According to an additional embodiment of the present invention, the device is configured to "walk" that is to move generally in a prescribed direction. According to a feature of the present invention, such a walking device comprises a perturbation generating means, the perturbation generating means configured to receive rotation data from the control unit and to generate periodic perturbations synchronized with the rotation of the device so as to cause the rotatable body to move in a prescribed direction. According to a feature of the present invention, the device further comprises a wireless data receiving means, configured to receive data from a remote location and pass the data to the control unit, for example to allow choosing by a user of the control unit to choose a direction towards which the device moves.

According to a feature of the present invention, a walking embodiment of the present invention is also configured with a display means, substantially as described hereinabove, the display means synchronized with the rotation of the device.

According to one embodiment of the walking embodiment of the present invention, the perturbation generating means comprises a mass-moving means configured to periodically move the center of mass of the rotatable body.

According to another embodiment of the walking embodiment of the present invention, the perturbation generating means comprise a air-resistance varying means configured to periodically change the air resistance of the rotatable body.

It is important to note that certain features of the present invention have been depicted or described in the context of separate embodiments for clarity. Such features are also provided, according to the teachings of the present invention in a single embodiment. Conversely, some features that have been described, for brevity, in the context of a single embodiment, amy also be provided separately or in some subcombination.

BRIEF DESCRIPTION OF THE DRAWINGS

The invention is herein described, by way of example only, with reference to the accompanying drawings, wherein:

FIG. 8 is a top view showing internal components of a fifth embodiment of a pair of top of the present invention having mutually communicating transceivers;

DETAILED DESCRIPTION OF THE INVENTION

Figure 1A:
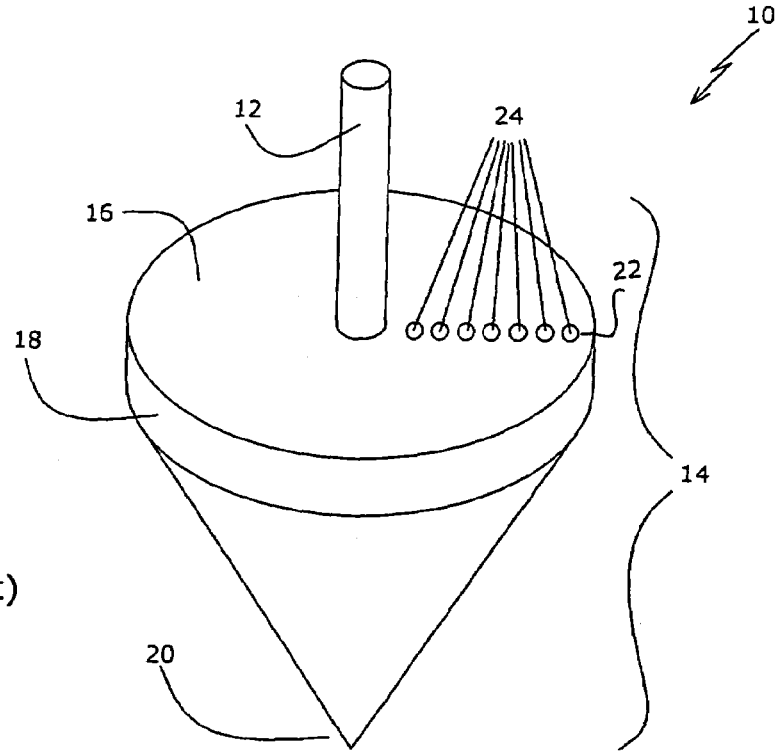
Fig. 1A (Prior Art)
FIG. 1A (prior-art) is a perspective view of a prior-art top with a non-synchronized display.

The present invention is of a rotating toy having a means to measure data associated with rotation of the toy, such as the rate of rotation of the toy. The measured data is used to implement a number of hitherto unavailable yet enjoyable games. Such games include viewing of an image synchronized with the rate of rotation, transmitting the data related to the rotation of the toy for the purposes of competition, or letting the rotating toy "walk", that is to move in a prescribed direction. The present invention is characterized by the fact that substantially the entire rotation data measuring means is associated with the toy itself. The principle and, uses of the method according to the present invention may be better understood with reference to the examples, description and the figures, in which like reference numerals refer to like parts throughout all of the figures. It is understood that the descriptions herein are illustrative and not intended to restrict the present invention to the specific details set forth below.

Figure 1B:
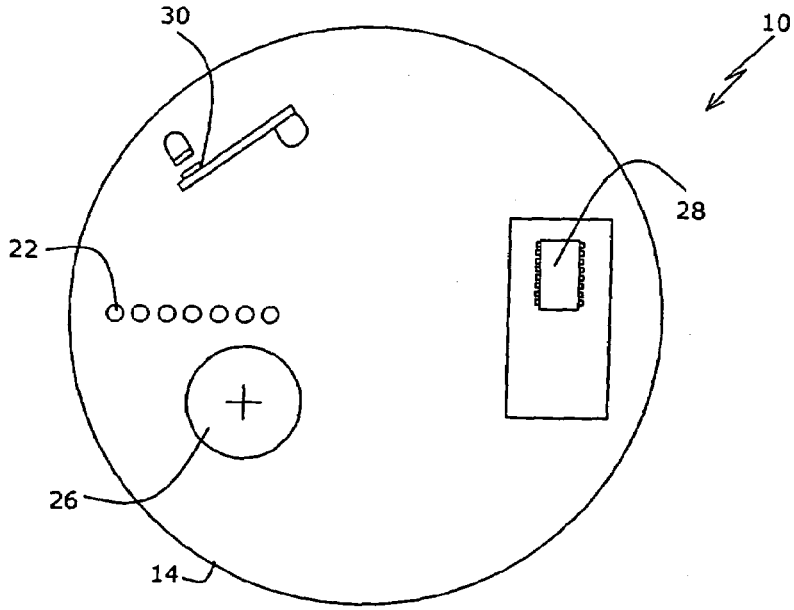
Fig. 1B (Prior Art)
FIG. 1B (prior-art) is a top view of the internal components of a prior-art top with a non-synchronized display.

In FIG. 1, a prior-art top 10 having a non-synchronized display, such as described in U.S. Pat. No. 5,791,966 is depicted. In FIG. 1A, top 10 is depicted in perspective view. In FIG. 1B, top 10 is depicted in a cut-out top view. Top 10 has a peg 12 and a substantially hollow body 14. The parts of body 14 are referred to as a crown 16, a shoulder 18, and a tip 20. For use, a user holds peg 12 between thumb and forefinger. When the thumb and forefinger are moved transversely, peg 12 converts translational motion to rotational motion of top 10. The gyroscopic effect causes top 10 to balance on tip 20 until friction reduces the rate of rotation to the point where the gyroscopic effect is insufficient to keep top 10 balanced on tip 20.

A display 22 comprising seven light emitting diodes 24 (LEDs) are arrayed in a row on crown 16. Contained within body 14 for controlling and activating display 22 are a power supply 26 (a battery), a control unit 28 and a centrifugal switch 30.

When top 10 is rotated at a sufficient rate, centrifugal switch 30 closes, powering control unit 28. Control unit 28 activates and deactivates each individual LED 24 of display 22 according to a predetermined pattern at a predetermined clocking speed. The clocking speed is chosen so that when the top is rotating at a certain rate the blinking of LEDs 24 resolves into an apparent image as a result of the effect of persistence of vision. The image is not apparent when top 10 rotates significantly faster or significantly slower than the predetermined rate of rotation for which the clocking speed was determined.

First Embodiment: Top with Synchronized Display and Centrifugal Switch

In FIG. 2 the internal details of a top 32 of the present invention are shown. FIG. 2A is of top 32 from a top view. FIG. 2B is a side view of top 32. FIG. 2C is of top 32 from a perspective view. Top 32 is substantially similar to prior-art top 10 excepting that top 32 includes a rotation data measuring means. In top 32 the rotation data measuring means includes an induction coil 34, analogue-to-digital converter 36 and modifications to control circuit 28. Substantially the rotation data measuring means supplies control unit 28 with data related to the rotation of top 32. Control unit 28 is configured to calculate a display rate based on the data, the display rate being a function of the actual rate of rotation of top 32. As in top 10, control unit 28 (a microprocessor/microcontroller) of top 32 activates and deactivates individual LEDs 24 of display 22 according to a predetermined pattern but at the calculated display rate which varies with the rate of rotation of top 32. Unlike prior-art top 10, the image produced by display 22 of top 32 is apparent at any rate of rotation that is measurable by the rotation data measuring means and where the effect of persistence of vision is significant.

Specifically, the rotation data measuring means of top 32 includes an induction coil 34 placed perpendicularly to the axis of rotation of top 32. When top 32 rotates, induction coil 34 also rotates. In FIG. 2, induction coil 34 comprises 1000 winds 38 of 0.1 mm diameter copper wire about a 2 cm long and 4 mm diameter ferrite core 40. The rotation of induction coil 34 in the magnetic field of the earth induces a sinusoidal current that can be detected at induction coil outputs 34*a* and 34*b*. As is clear to one skilled in the art, the frequency of the sinusoidal current is the rate of rotation of top 32. In top 32 outputs 34*a* and 34*b* are received by and digitized by analogue-to-digital converter 36 which then supplies the digitized signal to control unit 28. Control unit 28 is configured to obtain a frequency from a digitized periodic signal using a Fourier transform algorithm, and then calculate the rate of display so that the desired image is apparent throughout rotation of top 32.

It is clear to one skilled in the art that although the use of a Fourier transform algorithm is one option, there exist other implementable methods of calculating data relating to rotation of top 32 by analysis of the signals measured at outputs 34*a* and 34*b*. For instance, one alternative method is measuring the peak-to-peak time of the signal measured at induction coil outputs 34*a* and 34*b* and from that number, calculating the desired rotational data.

Figure 2A:
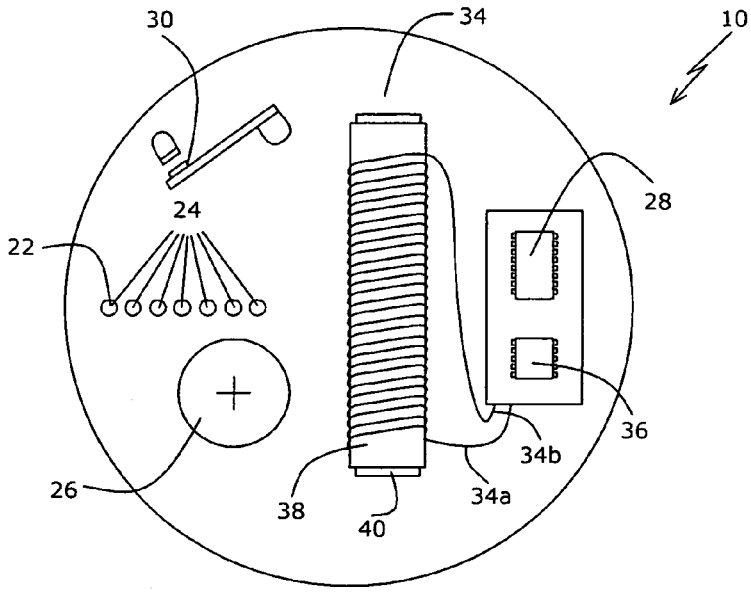
FIG. 2A is a top view showing internal components of a first embodiment of a top of the present invention with a synchronized display.
Figure 2B:
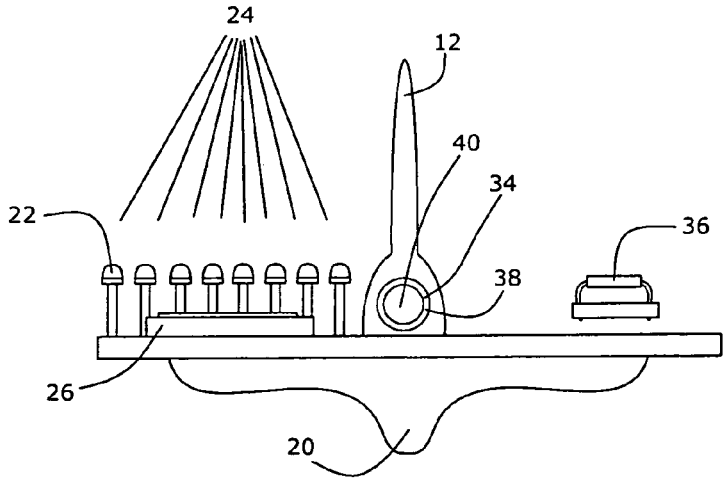
FIG. 2B is a side view showing internal components of a first embodiment of a top of the present invention with a synchronized display.
Figure 2C:
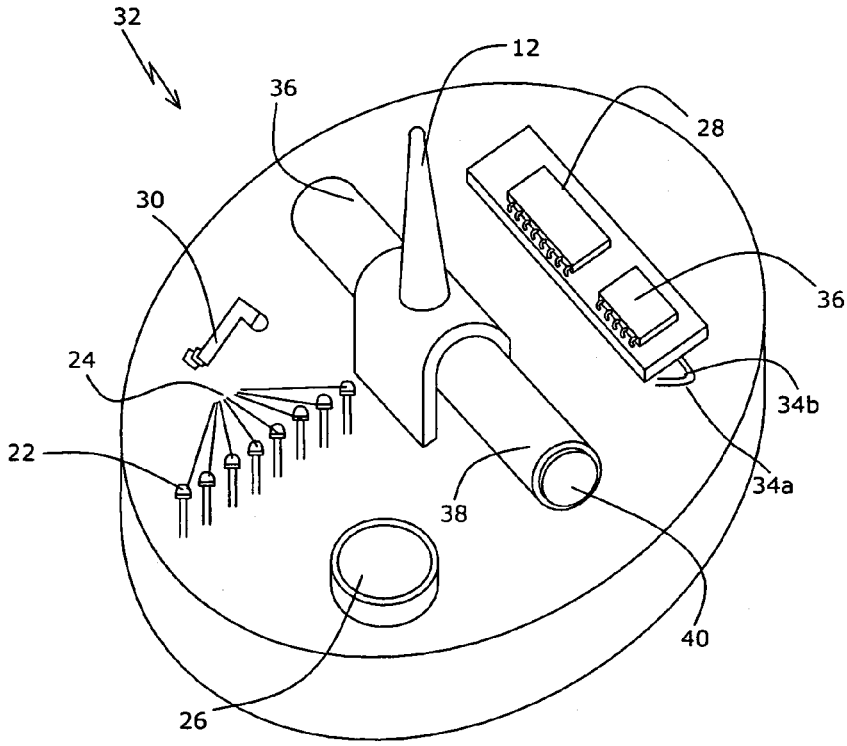
FIG. 2C is a perspective view showing internal components of a first embodiment of a top of the present invention with a synchronized display.
Figure 2D:
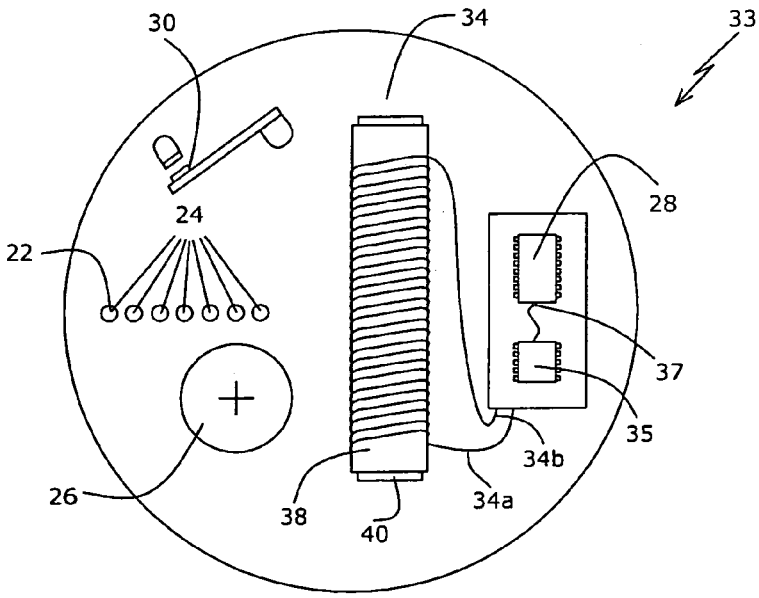
FIG. 2D is a top view showing internal components of a variation of a first embodiment of a top of the present invention with a synchronized display.

A variation of top 32 is depicted in FIG. 2D, top 33. In top 33, the signals of outputs 34*a* and 34*b* are routed into an operational-amplifier (op-amp) 35, op-amp 35 configured so that signal amplification is effectively infinite. As is clear to one skilled in the art, this results in the sinusoidal signal from outputs 34*a* and 34*b* being transformed, substantially, into a rectangular wave at output 37 of op-amp 35. The rectangular wave is then sent into control unit 28. Rotation data concerning top 33 is measured, for example, by measuring the rise-to-rise time of the signal from op-amp output 37. The preferred embodiment as depicted in top 33 is exceptionally suitable for implementation as it is very cheap, accurate, and works well even in fields distorted, for example, by the presence of large metal objects.

Top 32 or 33 is activated by spinning. Centrifugal switch 30 closes, activating control unit 28 to read a sequence of activation and deactivation of light elements 24 from a memory and to receive data to calculate the proper display rate. Control unit 28 activates and deactivates light elements 24 at the proper display rate (determined by control unit 28 based on date from the respective rotation data measuring means) so that the prestored image is apparent while top 32 or 33 rotates.

It is important to note that the memory where the image to be displayed is stored is usually an integral part of control unit 28. In some embodiments it can be chosen to have a separate memory unit, vide infra.

Second Embodiment: Top with Synchronized Display and Mode Selection

Figure 3:
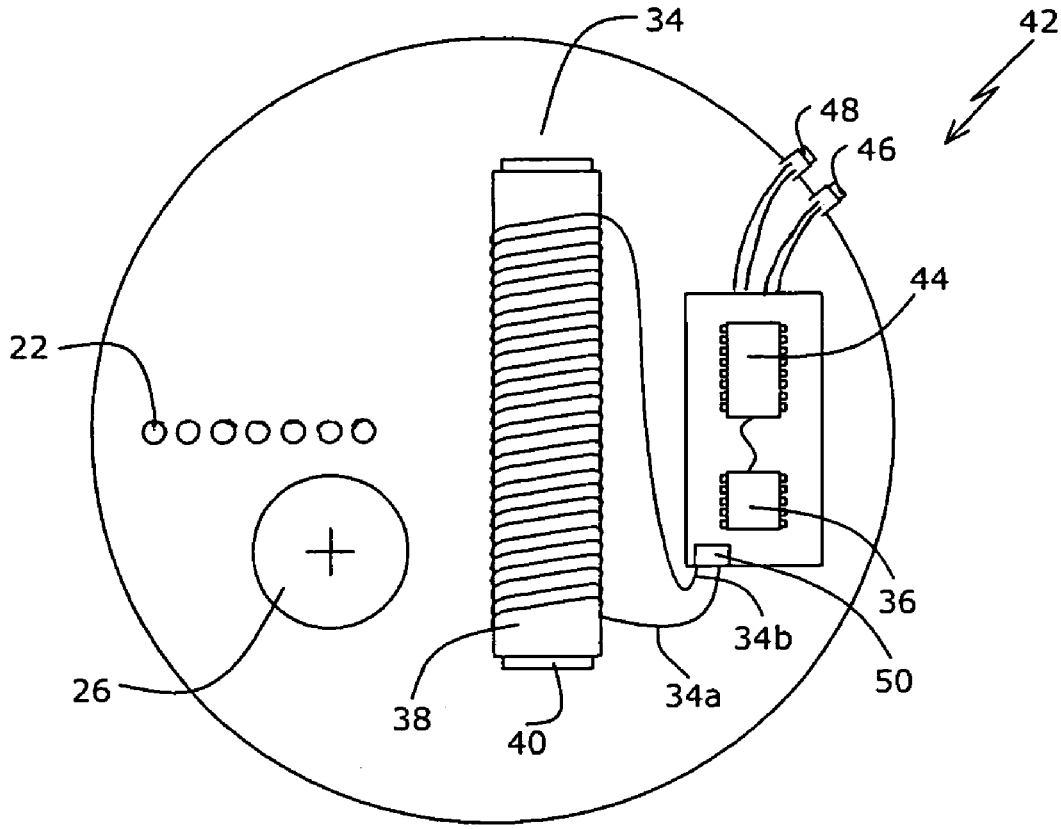
FIG. 3 is a top view showing internal components of a second embodiment of a top of the present invention with a synchronized display and mode selection.

In FIG. 3 a second embodiment top 42 of a toy of the present invention is depicted. Control unit 44 is a multimode control unit. Like control unit 28 discussed hereinabove, control unit 44 is configured to read a sequence of activation and deactivation of light elements 24 from a memory and by performing the activation and deactivation at the proper display rate (supplied by the rotation data measuring means) allows a prestored image to be apparent while top 42 rotates. However, control unit 44 is multimodal meaning that it is configured to select different images or perform other functions, collectively referred to as modes. Some modes that can be implemented are discussed hereinbelow.

Unlike prior-art top 10 and top 32, top 42 is not provided with a centrifugal switch 28. Instead, top 42 is provided with a first microswitch 46. First microswitch 46 is configured to toggle control unit 44 to an "on" state. Once activated by first microswitch 46, control unit 44 detects a rate of rotation of top 42. If the rate of rotation is substantially zero for longer than a predetermined time, e.g. 2 minutes, control unit 28 automatically toggles to an "off" state.

Top 42 is also provided with a second microswitch 48 coupled to control unit 44. Second microswitch 48 acts as a mode selector buttons optionally in conjunction with first microswitch 46. The use of microswitches coupled to multimode control units, such as 44, is well known in the art, for example in the field of digital wristwatches. Top 42 is also provided with an amplifier 50. Amplifier 50 receives a sinusoidal signal from outputs 34*a* and 34*b*, and both amplifies and filters the signal before sending the signal to analogue-to-digital converter 36.

For use, first microswitch 46 is pressed, activating control unit 44. Second microswitch 48 and first microswitch 46 are then pressed in a proper order so as to select one of a plurality of possible modes. Once a specific mode is selected and top 42 is rotated, control unit 44 detects the rate of rotation and displays an image appropriate to the selected mode. With appropriate modification to the control unit 44, top 42 is used to play a variety of exciting and entertaining games.

It is important to note that it is possible and often advantageous to provide a single top both with a plurality of microswitches (such as 46 and 48) for activating the top and selecting modes and also a centrifugal switch (such as 28).

It is important to note that it is possible and often advantageous to provide a toy of the present invention with neither microswitches (e.g. 46 and 48) nor a centrifugal switch (e.g. 30). Rather, the respective control unit is, when the toy is not in use, in a low-energy use "stand-by" mode. The respect control unit exits the "stand-by" mode upon receiving a signal from the respective rotation data measuring means and functions further as described herein.

Some modes that can be chosen are discussed hereinbelow. The modes discussed hereinbelow are exemplary: one skilled in the art is aware that a control unit such as 44 can be configured to have many other modes.

There are innumerable potential games and modes that can be implemented using the present invention. A few non-limiting examples are listed hereinbelow. It is important to note that a top 32 can generally be configured to include but one mode, whereas a top such as 42 can be configured to include a plurality of modes.

Figure 4:
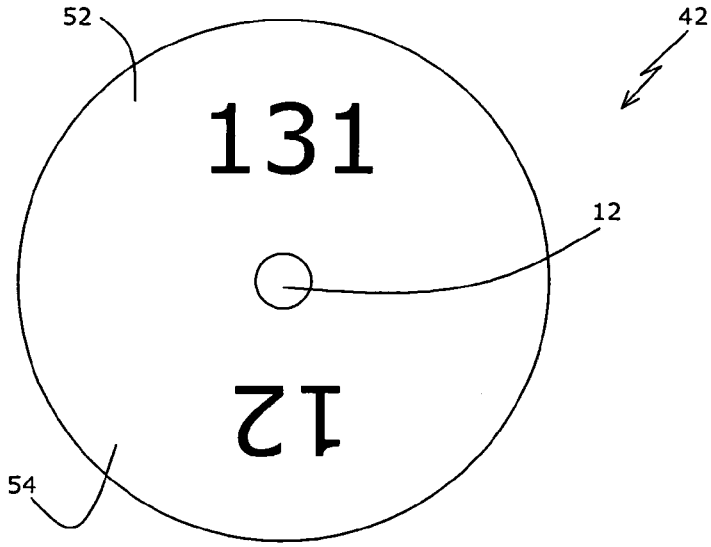
FIG. 4 is a top view of a top of the present invention with a synchronized display during rotation, displaying a maximum number of rotations and a current number of rotations.

A first mode involves adding a memory accessible to a respective control unit of a toy to act as a rotation counter. The memory is configured to increment a value corresponding to the number of rotations every time the control unit detects a full rotation. The control unit uses a respective display to display the number of times the toy has rotated. A person can compete solitaire or against others to see what maximum number of rotations can be attained. In an exceptional entertaining version of this mode, depicted in FIG. 4 (top view during spinning) a top 42 is provided with a first memory acting as a rotation counter and a second "high-score" memory as a maximum rotations memory. The control unit displays both the maximal number of rotations achieved 52 as well as the current number of rotations 54, incremented as top 42 rotates. The winner is a player who causes the top to rotate a greatest number of times. It is most useful in such an embodiment to provide a reset button to erase the "high-score" memory.

A second mode involves knowing the rate of rotation of the toy. The respective control unit is configured to use a diplay of the present invention to display the rate of rotation. In an exceptional entertaining version of this game the toy is provided with a first memory acting as a current rate of rotation counter and a second "high-score" memory as a maximum rate of rotation memory. The control unit uses the display to display both the maximal rate of rotation achieved as well as the current rate of rotation. The winner is a player who spins the toy the fastest.

A third mode involves adding a random number generator, a random number memory, a spin memory, a comparing means, a reset button and a rotation counter. The random number generator is activated and stores a random number in the random number memory. The control unit displays the random number as well as the number of rotations currently achieved. Each player in succession attempts to rotate the toy a number of times equal to the number stored in the memory and the number of rotations actualy achieved is stored in the spin memory. After all players have made an attempt, the control unit uses the comparing mean to determine is the winner, that which player rotated the toy in a number closest to the randomly determined number. The closest player is the winner and the display is used to indicate the winner.

A fourth mode involves adding a random number generator so that the toy of the present invention is used as a die. For example, a selector button is used to input the maximum number that can be generated (i.e. the number of faces of the die). During rotation of the toy, the random number generator generates a random number within the selected range and displays the random number.

Figure 5:
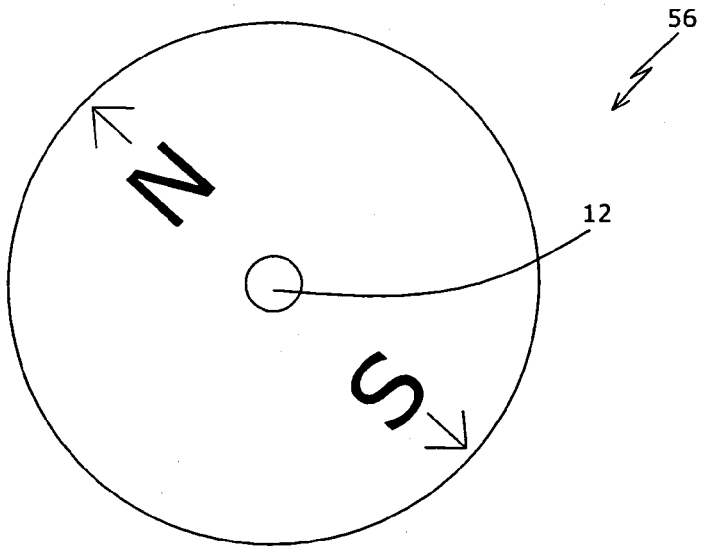
FIG. 5 is a top view of a top of the present invention with a synchronized display during rotation, used as a compass and indicating north and south.

A fifth mode uses a toy of the present invention to indicate directions, such as North and South, as depicted in FIG. 5. In FIG. 5, top 56 is depicted from the top while rotating. The display of top 56 indicates North and South. Clearly, any direction can be indicated. The fifth mode is implemented when the rotation data measuring means is configured to detect the earth's magnetic field, for example when the rotation data measuring means includes an induction coil such as top 32 or 42. The respective control unit of top 56 is configured to analyze the signal received from the rotation data measuring means to identify the directions and indicate them using the respective display.

In principle any light source can be used in implementing a synchronized display embodiment of the device of the present invention. LEDs, as depicted in FIGS. 2, 3, 4 and 5 are preferred as being generally available, low-cost, efficient in energy consumption and most importantly, can be quickly toggled between an activated and deactivated state. Ideally the light sources are multicolor light sources, that is that the same light source is configured to produce more than one color of light on request. Multicolored LEDs are known in the art. When multicolored LEDs are used, a corresponding control unit is adapted to choose an appropriate color for an LED that is activated so that highly detailed and esthetic figures become apparent.

The number of light sources, such as LEDs 24, used in implementing a synchronized display embodiment of the device of the present invention varies and generally determines the detail with which a figure depicted is observed. It is important to note that although LEDs 24 are depicted in FIGS. 2 and 3 arranged as extending in a row outwards from the axis of rotation (running through peg 12) this is not necessary. Although a linear arrangement is generally easier to manufacture and assemble, it is clear to one skilled in the art that when implementing the present invention it is only necessary that there be light sources arrayed at different distances from the axis of rotation of the specific toy.

Third Embodiment: Plunger Top with Animated Display

As is clear to one skilled in the art, the teachings of the present invention allow for a display synchronized so as to be insensitive to the rate of rotation. Consequently, an image can be displayed for much longer periods of time then heretofore possible. Using the teachings of the present invention, it becomes practical to display complex images, for example images that include animation.

A third embodiment of the present invention that is useful for the display of animated images is a plunger top having a rotation data measuring means and a synchronized display. Plunger tops are extremely popular amongst small children because, due to the plunger mechanism, even small children can rotate a plunger top quickly and for extended periods of time. However, small children do not usually have the ability to rotate a plunger top at a selected speed. When a plunger top is manufactured in accordance with the teachings of the present invention, children of all ages can rotate the plunger top at any speed and enjoy an animated story.

Figure 6A:
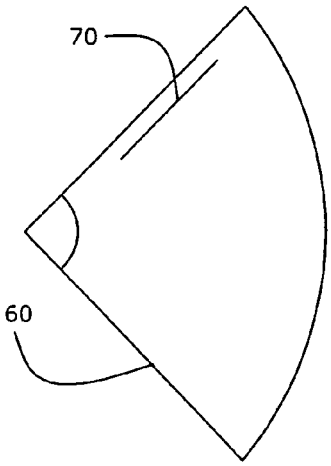
FIG. 6A is a perspective view of the third embodiment of the present invention, a plunger top configured according to the teachings of the present invention with a synchronized display to display animated stories with a top body cover removed to show internal components.
Figure 6A:
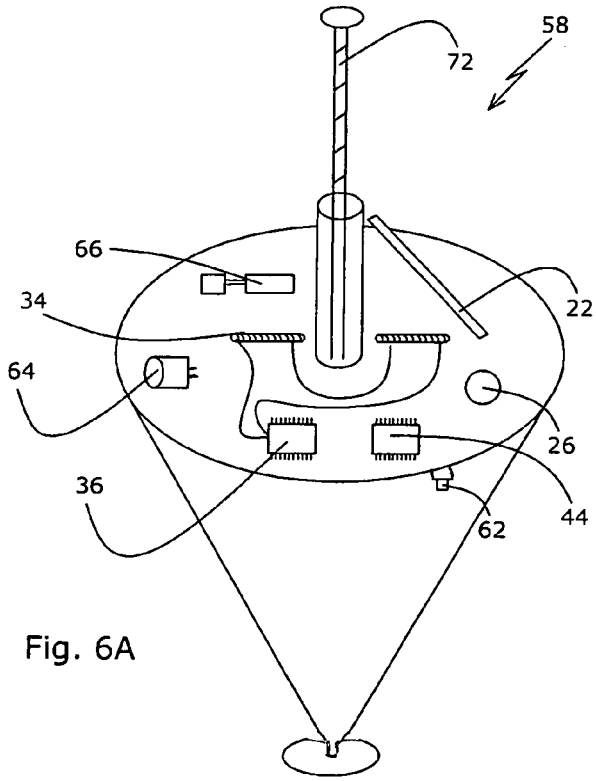
Figure 6B:
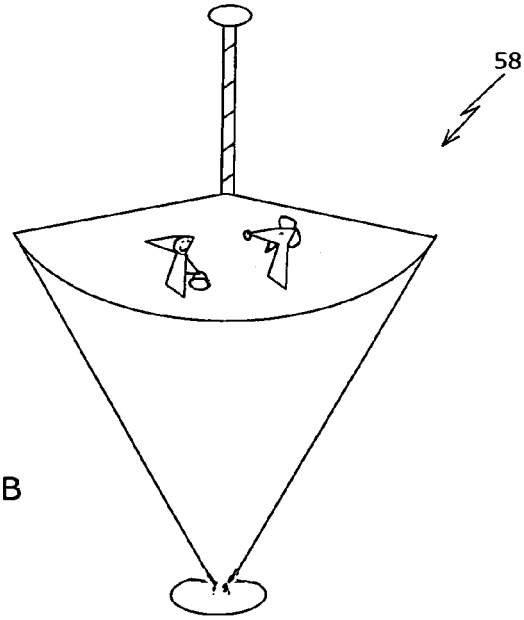
FIG. 6B is a perspective view of the third embodiment of the present invention, a plunger top configured according to the teachings of the present invention having a synchronized display to display animated stories during rotation.

In FIG. 6 is depicted a plunger top 58 of the present invention. In FIG. 6A plunger top 58 is shown with upper body cover 60 removed to show the internal components of plunger top 58. In FIG. 6B plunger top 58 is shown from a perspective view while spinning and displaying Little Red Riding Hood deep in discussion with the Wolf dressed up as her Grandmother. Plunger top 58 is substantially a prior-art plunger top modified in accordance to the teachings of the present invention. In addition to previously described rotation data measuring means components (display 22, induction coil 34, analogue-to-digital converter 36, and an appropriately modified control unit 44) there is also found a reset button 62, a speaker 64, a memory unit 66 configured to store an animated story (including audio data for play using speaker 64 and video data as instructions used by control unit 44 to operate display 22). For plunger top 58, control unit 44 is configured to include a pointer for keeping a record as to what point the animated story has been related. When a user activates plunger top 58 to a minimum speed, control unit 44 uses speaker 64 and display 22 to playback the animated story stored in memory unit 66. Irrespective of the rate of rotation, the video data and the audio data are played back without distortion: play back is not influenced by the acceleration and deceleration of plunger top 58 itself. The pointer is continuously updated to store at what point the animated story has been played. If plunger top 58 stops rotating and is then restarted, the story continues at the point which it stopped. Only when reset button 62 is pressed, is the pointer set to indicate that the animated story must be replayed from the beginning.

It is important to note that in an animated display it is generally desired to have a high resolution. Thus, display 22 of plunger top 58 is provided with fifty individual multicolored LEDs. When upper body cover 60 is in place, display 22 emerges through slot 70 in upper body cover 60.

Induction coil 34 is a two-part induction coil so that plunger 72 can pass through the rotation axis of plunger top 58. In other, non-depicted, embodiments of the present invention, an induction coil is not split, but rather not found in the center of a respective top.

Memory unit 66 is preferably compact in size. Further, it is preferable that the story stored on memory unit 66 can be changed, for example by writing a new story on an existing memory unit or by physically replacing a first memory unit storing a first story with a second memory unit storing a second story. A suitable technology for implementing a memory unit 66 is a rewritable memory unit such as flash-based data storage (for example, as manufactured by M-Systems Ltd. Kfar Saba, Israel). Such memory units can be configured to be physically installed and removed in a socket. Thus, a person interested in an additional animated film can purchase a new memory unit 66 and replace an old one. Such memory units can also be easily rewritten. For example, using suitable adapters and software, a new animated story can be downloaded, for example through the Internet or using a cellular telephone service, and stored on a memory unit 66.

It is clear to one skilled in the art that some or all of the entertaining modes or games listed above can be integrated in one toy of the present invention, and which specific game to play can be chosen, for example, by a switch or selector button.

Fourth Embodiment: Rotating Top with Transmitter

Figure 7:
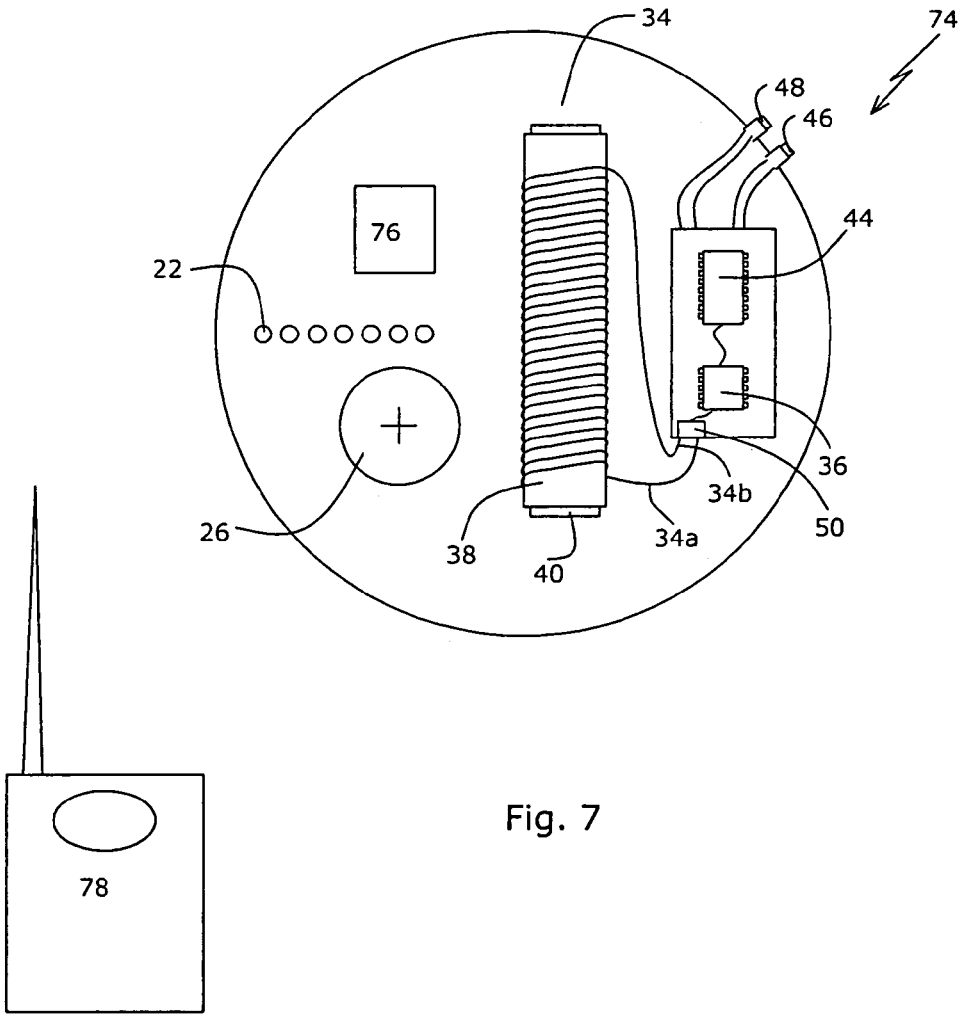
FIG. 7 is a top view showing internal components of a fourth embodiment of a top of the present invention having a transmitter.

In FIG. 7 is depicted a fourth embodiment of the present invention, a top 74. Top 74 is substantially similar to top 42 depicted in FIG. 3 with the significant difference that top 74 is further provided with a transmitter 76. Transmitter 76 is configured to take information related to the rotation of top 74 (rate of rotation, number of rotations counted, acceleration) from control unit 44 and transmit the information to a remote device 78.

Remote device 78 can be any one of many different devices configured to receive rotation data from top 74 and then do some action with the rotation data, preferably an entertaining action. For example, remote device 78 may be configured to display the rotation data. Games involving comparing or tallying rotation data are easily developed and implemented. Preferred remote devices include dedicated display units, mobile phones, personal computers and personal digital assistances.

Transmitter 76 is implementable by any of the wireless transmission technologies known in the art. Such transmission technologies include, but are not limited, to sound waves (e.g. ultrasound), regular radio transmission, infrared transmission and Bluetooth® technology.

Although top 74 is depicted in FIG. 7 as having a synchronized display, it is clear that such a display is not necessary. In a different, not-depicted, embodiment of the fourth embodiment of the present invention is provided a rotating toy with a rotation data measuring means and a transmitter 76 configured to transmit the data to a remote location, such as 78, but not having a synchronized display such as 22.

Fifth Embodiment: Rotating Toy with Transceiver

In an exceptionally entertaining embodiment of the present invention, depicted in FIG. 8, two tops 80*a* and 80*b* are provided with transceivers 82. Transceivers 82 are configured to mutually communicate rotation data. In one game employing such a set of two transceiver-equipped toys, a top rotating at a greater rate flashes blue, whereas a top rotating at a lesser rate flashes red.

Other competitive games based on using a plurality of mutually communicating rotating toys, such as tops 80*a* and 80*b*, can be conceived by one skilled in the art upon perusal of the description herein.

Sixth Embodiment: Walking Rotating Toy

A sixth embodiment of the present invention making use of rotation data measured according to the teachings of the present invention is a walking toy.

In FIG. 9 is depicted top 84. Top 84 is substantially identical to top 42 depicted in FIG. 3 except that in addition, top 84 is configured to walk, that is to move in a certain direction.

Figure 9A:
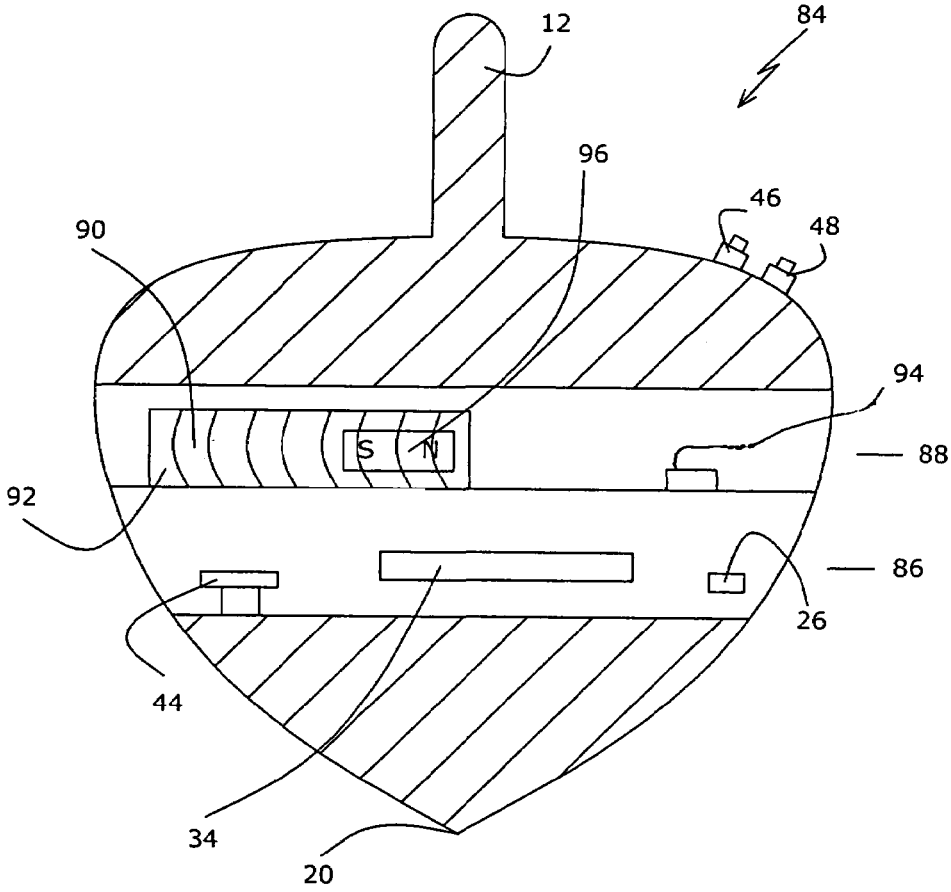
FIG. 9A is a side cross section view showing internal components of a sixth embodiment of top of the present invention configured to "walk"

In FIG. 9*a*, top 84 is depicted in cross-section from the side. It is seen that top 84 is divided into two levels, lower level 86 and upper level 88. In lower level 86 are found the components already discussed for top 42, including control unit 44, an induction coil 34 and a power supply 26. In upper level 88 are found the additional components that allow top 84 to move in a prescribed direction.

Figure 9B:
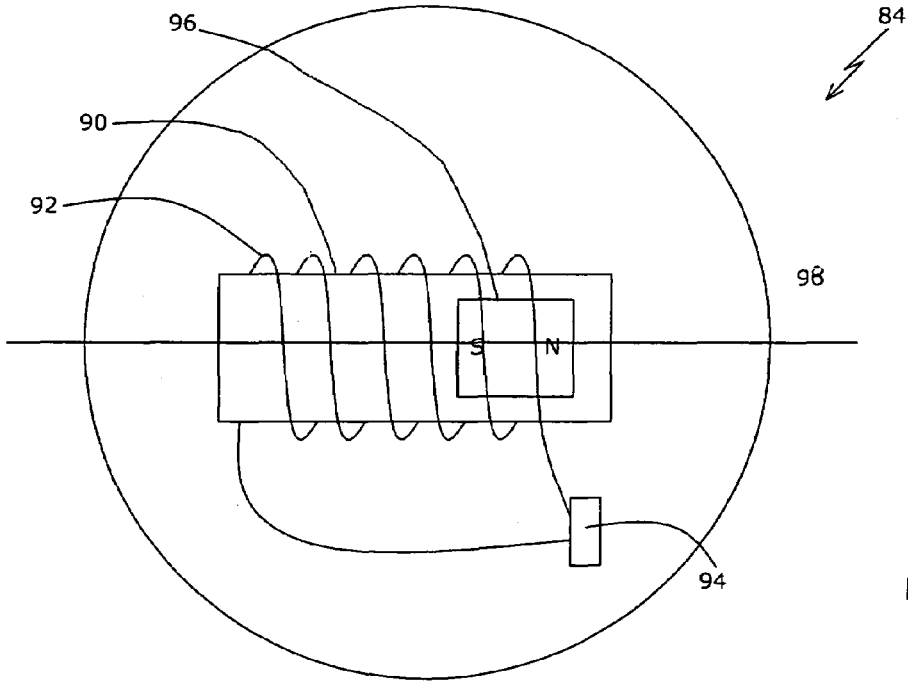
FIG. 9B is a top view showing internal components of a sixth embodiment of a top of the present invention configured to "walk" in a rest position.
Figure 9C:
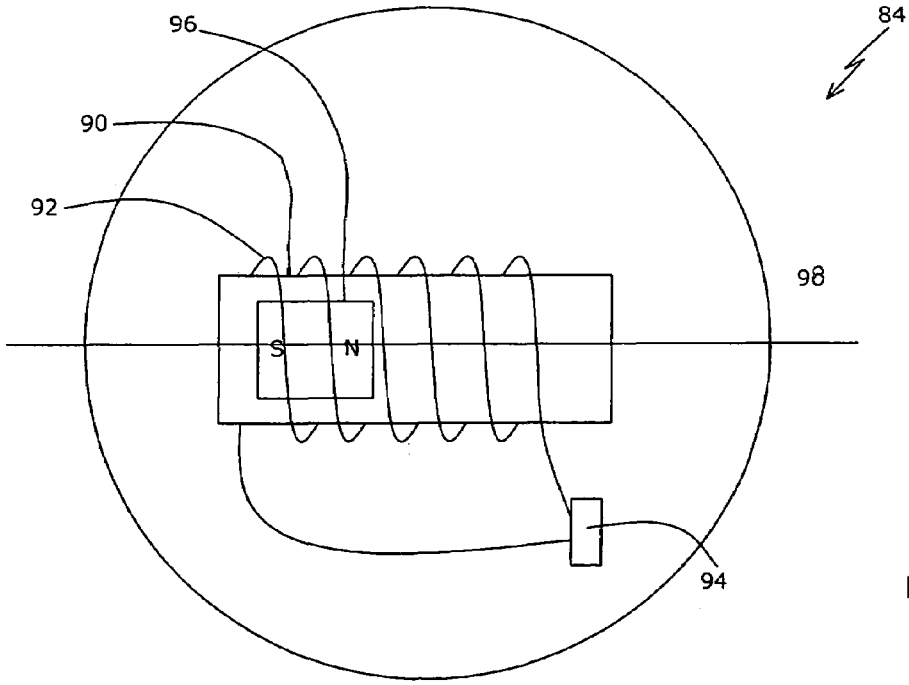
FIG. 9C is a top view showing internal components of a sixth embodiment of a top of the present invention configured to "walk" in a translated position.

In FIG. 9*b* is depicted a top view of upper level 88. Disposed on upper level 88 is a tube 90 surrounded by an electrical coil 92. Electrical coil 92 receives power from battery 26 through switch 94. Switch 94 is configured to open and close upon receipt of appropriate signals from control unit 44. Inside tube 90 is found magnet 96. Magnet 96 is configured to slide back and forth within tube 90 parallel to tube axis 98, with substantially no component of motion perpendicular to tube axis 98, from a rest position (depicted in FIG. 9*b*) to a translated position (depicted in FIG. 9*c*). Magnet 96 is further configured to encounter as little friction as possible inside tube 90. This is achieved, for example, by coating magnet 96 and the inside of tube 90 with polytetrafluoroethylene (PTFE). When switch 94 is activated, a magnetic field is induced by electrical coil 92 causing magnet 96 to move along tube axis 98 to the translated position. When desied, switch 94 is activated again to reverse the direction of the induced magnetic field, causing magnet 96 to move to the rest position.

It is important to note that the location of the components of upper level 88 and described hereinabove are situated so that in the rest position (FIG. 9*b*) of magnet 96, top 84 is balanced so as to stable rotate. However, when magnet 96 is in the translated position (FIG. 9*c*), magnet 96 is not in balance and the force of gravity tilts top 84. Gyroscopic forces will cause top 96 to move perpendicularly to the direction of the tilt.

As is known to one skilled in the art, in a prior-art top, since the imbalance also rotates, the imbalance leads to precession of the prior-art top but no net translational motion of the top itself. However, according to the teachings of the present invention, the positioning of magnet 96 in the translated position is synchronized with the rotation of top 84. As is clear to one skilled in the art, the resulting perpendicular gyroscopic force is substantially only in one direction and as a result top 84 will walk, that is move substantially in one direction.

For use, top 84 is rotated. As top 84 rotates, induction coil 34 sends data relating to the rotation of top 84 to control unit 44. Control unit synchronizes activation of switch 94 so that magnet 96 is found in the translated position only at a certain absolute position or limited ranges of position, e.g. a quadrant. The imbalance of top 84 that occurs only at one specific absolute position causes top 84 to walk in a designated direction. Selection of which direction can be made using switches 46 and 48 and is preferably implementable relative to a magnetic direction, easily detectable using an induction coil 34, as described hereinabove.

In a frictionless environment, the conservation of momentum will cause top 84 to tilt in a direction that is opposite to that of magnet 96. Thus, in a frictionless environment, top 84 will not walk. The inventor has found, however, that there is sufficient friction between a tip 20 of a top 84 with a surface on which top 84 rotates so as to allow significant walking. Further, once top 84 tilts, the angle with which the tip of top 84 touches the surface on which top 84 rests is changed. The resulting change in the friction force vector contributes to the "walking" of top 84.

Figure 10A:
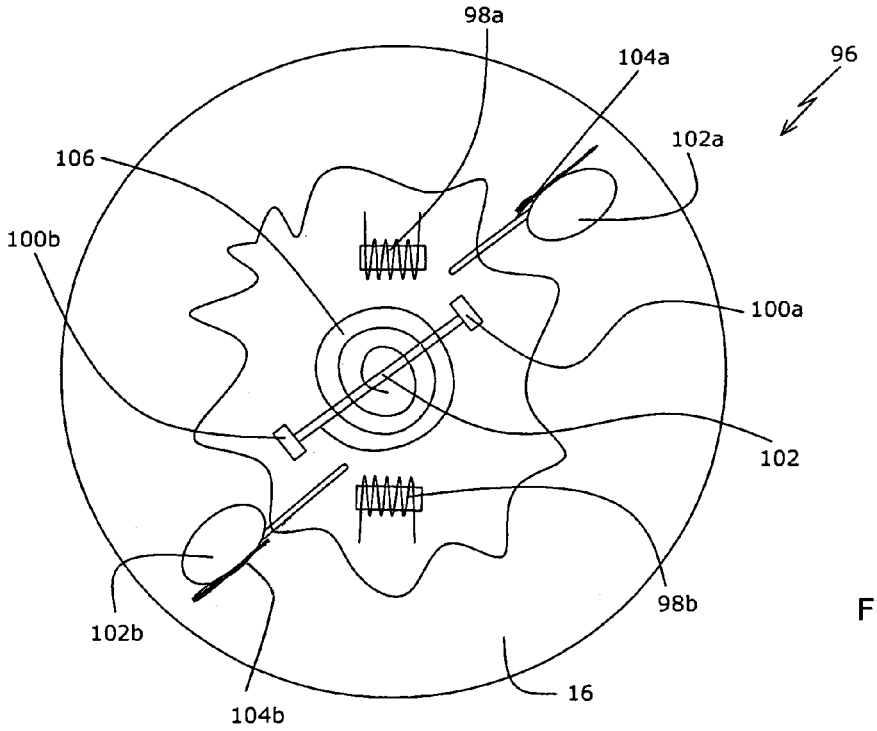
FIGS. 10A and 10B are perspective views showing internal components of a seventh embodiment of a top of the present invention configured to "walk" in a translated position.
Figure 10B:
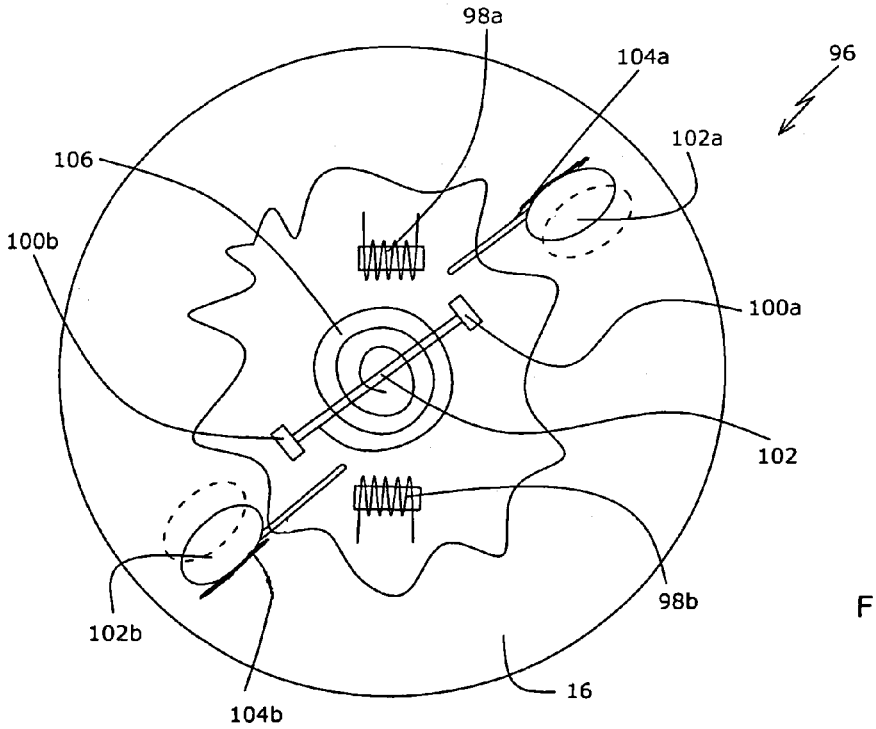

It is important to note that the activation of electrical coil 92 generates a magnetic field that is detected by induction coil 38 and thus adds noise to the signal that induction coil 38 provides to control unit 44. One method of overcoming problems caused by the magnetic field generated by electrical coil 92 is by configuring control unit 44 to provide a feedback current into induction coil 38 simultaneously with the powering of electrical coil 92. The intensity of the feedback current neccesary can easily be found by calculation or by empirical measurement. An alternative method of overcoming any problems caused by the magnetic field generated by electrical coil 92 is by ignoring the intermittent high intensity yet narrow signals produced by electrical coil 92. Ignoring such signals and yet retaining the ability to accurately measure the rotation of top 84 is a simple matter when the method of calculation of rotation is based on analyzing a sinusoidal signal, as is done in a preferred embodiment of the present invention An additional embodiment of a walking top 96 is depicted in FIG. 10. In order to periodically vary the air resistance, electromagnets 98*a* and 98*b* are periodically energized by commands from a control unit 44. When electromagnets 98*a* and 98*b* are energized, magnets 100*a* and 100*b* are drawn to a respective magnet in a rotating motion dictated by axis 102 to which magnets 100*a* and 100*b* are fixed. As magnets 100*a* and 100*b* approach electromagnets 98*a* and 98*b*, magnets 100*a* and 100*b* push flaps 102*a* and 102*b* upwards to emerge through crown 16, increasing air resistance (FIG. 10B). As flaps 102*a* and 102*b* are fixed to crown 16 by hinges 104*a* and 104*b*, flaps 102*a* and 102*b* remain in place. When electromagnets 98*a* and 98*b* are de-energized, spring 106 forces magnets 100*a* and 100*b* back into place and away from flaps 102*a* and 102*b* (FIG. 10A). Flaps 102*a* and 102*b* are forced back into place flush with crown 16 by the air flow.

Whereas walking top 84 "walks" as a result of forces exerted by gravity, friction and periodic imbalance of top 84 the periodicity of the imbalance synchronized with the rotation of top 84, top 96 "walks" as a result of force of air on top 96 that is varied by periodically changing the air resistance of top 96, the periodicity being synchronized with the rotation of top 96.

Seventh Embodiment: Walking Talking Rotating Toy

As is clear to one skilled in the art, it is possible to integrate, into one rotating toy, the features of the second, fifth and the sixth embodiment of the present invention to yield a walking talking toy.

In such an embodiment it is most preferable that a toy has a transceiver 82, such as depicted for tops 80 in FIG. 8. Further, control unit 44 is configured to synchronize the direction of the walking function of the toy as a result of input received from transceiver 82.

When playing a game, with a walking talking top, first the top is spun. An arrow is depicted using display 22 so as to give an operator a reference as to the direction of movement of top. An operator uses a remote unit 78 to transmit signals that correspond to commands to the top to turn left, right, move forward, move back or stop. The signals transmitted are received by transceiver 82 and directed to control unit 44. Control unit 44 adjusts the image displayed by display unit 22 to display the new direction of motion of top. Control unit 44 synchronizes activation of switch 94 so as to direct the top to walk in the direction commanded by the operator using remote unit 78.

A person using a seventh embodiment of the present invention is in fact steering the top. Such a game combines the fun of a spinning toy with that of a remote-controlled vehicle. A related game adds a twist of dueling between a plurality of walking talking tops.

The examples in the description hereinabove have depicted only a top or a plunger top. One skilled in the art, upon study of the disclosure herein, can apply the teachings of the present invention to other rotating toys including but not limited to string tops, flyings disks, yo-yos, roulette wheels, ko-en-gen, balls and boomerangs, depending in the exact embodiment desired. Clearly the walking option is only implementable for toys that are in contact with a surface and having sufficient friction therewith.

The present invention is not limited to the embodiment described herein but also relates to all kinds of modifications thereof, insofar as they are within the scope of the claims.

The invention claimed is:

1. A rotating device comprising:

(a) a rotatable body;

(b) a rotation data measuring arrangement deployed inside said rotatable body;

(c) a control unit configured to receive data relating to rotation of said rotatable body from said rotation data measuring arrangement; and (d) a perturbation generating mechanism configured to receive data from said control unit and to generate periodic perturbations synchronized with the rotation of the device so as to cause said rotatable body to move in a prescribed direction.

2. The device of claim 1, wherein said rotatable body is one of the objects selected from the group consisting of tops, flying disks, flying rings, boomerangs, roulette wheels, yo-yos, balls, and ko-en-gen.

3. The device of claim 1, further comprising a wireless data receiver configured to receive data from a remote location and pass said data to said control unit.

4. The device of claim 1, wherein said perturbation generating mechanism includes a mass moving arrangement configured to periodically move the center of mass of said rotatable body.

5. The device of claim 1, wherein said perturbation generating mechanism includes an air-resistance varying arrangement configured to periodically change the air resistance of said rotating body.

6. The device of claim 1, further comprising a wireless data transceiver configured to receive rotation data from said control unit and transmit said rotation data to a remote location, and further configured to receive data from a remote location and pass said data to said control unit.

7. A rotating device comprising:

(a) a rotatable body;

(b) a rotation data measuring arrangement deployed inside said rotatable body, said rotational data measuring arrangement being configured to detect the magetic field of the Earth, and said rotation data measuring arrangement is configured to produce a substantially sinusoidal out signal having a frequency related to rotation of said rotatable body;

(c) a control unit configured to receive data relating to rotation of said rotatable body from said rotation data measuring arrangement; and (d) a perturbation generating mechanism configured to receive data from said control unit and to generate periodic perturbations synchronized with the rotation of the device so as to cause said rotatable body to move in a prescribed direction.

8. The device of claim 7, wherein said rotatable body is one of the objects selected from the group consisting of tops, flying disks, flying rings, boomerangs, roulette wheels, yo-yos, balls, and ko-en-gen.

9. The device of claim 7, further comprising a wireless data receiver configured to receive data from a remote location and pass said data to said control unit.

10. The device of claim 7, wherein said perturbation generating mechanism includes a mass moving arrangement configured to periodically move the center of mass of said rotatable body.

11. The device of claim 7, wherein said perturbation generating mechanism comprise an air-resistance varying arrangement configured to periodically change the air resistance of said rotating body.

12. The device of claim 7, further comprising a wireless data transceiver configured to receive rotation data from said control unit and transmit said rotation data to a remote location, and further configured to receive data from a remote location and pass said data to said control unit.

13. A rotating device comprising:

(a) a rotatable body;

(b) a rotation data measuring arrangement deployed inside said rotatable body;

(c) a control unit configured to receive data relating to rotation of said rotatable body from said rotation data measuring arrangement;

(d) a display disposed along at least a portion of said rotatable body;

(e) a display controller for controlling display of images on said display;

(f) a clock arrangement coupled to said display controller for refreshing said display of images on said display at a clock rate, wherein said clock rate is dependent on said rotation data; and (g) a perturbation generating mechanism configured to receive data from said control unit and to generate periodic perturbations synchronized with the rotation of the device so as to cause said rotatable body to move in a prescribed direction.

14. The device of claim 13, wherein said rotatable body is one of the objects selected from the group consisting of tops, flying disks, flying rings, boomerangs, roulette wheels, yo-yos, balls, and ko-en-gen.

15. The device of claim 13, further comprising a wireless data receiver configured to receive data from a remote location and pass said data to said control unit.

16. The device of claim 13, wherein said perturbation generating mechanism includes a mass moving arrangement configured to periodically move the center of mass of said rotatable body.

17. The device of claim 13, wherein said perturbation generating mechanism includes an air-resistance varying arrangement configured to periodically change the air resistance of said rotating body.

18. The device of claim 13, further comprising a wireless data transceiver configured to receive rotation data from said control unit and transmit said rotation data to a remote location, and further configured to receive data from a remote location and pass said data to said control unit.

19. The device of claim 13, wherein said rotation data measuring arrangement includes a means for detecting the magnetic field of the Earth.

20. A rotating device comprising.

(a) a rotatable body;

(b) a rotation sensor deployed inside said rotatable body, said rotation sensor being responsive to rotation of said rotatable body within the Earth's magnetic field to produce an output signal indicative of revolutions of said rotatable body relative to the Earth's magnetic field;

(c) a display disposed on said rotatable body; and (d) a controller configured to actuate said display so as to show content, said controller being responsive to said output signal so as to synchronize said display with rotation of said rotatable body such that said content appears substantially non-rotating as said rotatable body rotates, wherein said controller is configured to operate in at least a first mode wherein said content includes alphanumeric symbols which vary as a function of one of the group consisting of: a number of revolutions of said rotatable body during a current spinning motion, and a rate of rotation of said rotatable body.

21. The device of claim 20, wherein said rotatable body is one of the objects selected from the group consisting of tops, flying disks, flying rings, boomerangs, roulette wheels, yo-yos, balls, and ko-en-gen.

22. The device of claim 20, wherein said controller is configured to determine from said output signal a true direction of rotation.

23. The device of claim 20, wherein said rotation sensor includes an induction coil.

24. The device of claim 20, wherein said display includes a plurality of independently activatable and deactivatable light sources.

25. The device of claim 20, further comprising a wireless data receiver configured to receive data from a remote location and pass said data to said controller.

26. The device of claim 20, further comprising a wireless data transceiver configured to receive rotation data from said controller and transmit said rotation data to a remote location, and further configured to receive data from a remote location and pass said data to said controller.

27. The rotating device of claim 20, wherein said content indicates a cumulative number of revolutions of said rotatable body during a current spinning motion.

28. The rotating device of claim 27, wherein said controller is fiber configured to compare said cumulative number of revolutions with a previous maximum number of revolutions.

29. The rotting device of claim 27, wherein said controller is further configured to compare said cumulative number of revolutions with a randomly generated target number of revolutions.

30. The rotating device of claim 20, wherein said content indicates a current rate of rotation of said rotatable body.

31. The rotating device of claim 30, wherein said controller is further configured to compare said current rate of rotation with a previous maximum rate of rotation.

32. A rotating device comprising:

(a) a rotatable body;

(b) a rotation sensor deployed inside said rotatable body, said rotation sensor being responsive to rotation of said rotatable body within the Earth's magnetic field to produce an output signal indicative of revolutions of said rotatable body relative to the Earth's magnetic field;

(c) a display disposed on said rotatable body; and (d) a controller configured to actuate said display so as to show content, said controller being responsive to said output signal so as to synchronize said display with rotation of said rotatable body such that said content appears substantially non-rotating as said rotatable body rotates, wherein said controller is further responsive to said output signal so as to switch the device to a low-power mode when said output signal is indicative of a near-zero rate of rotation for a predetermined time.

33. The rotating device of claim 32, wherein said low-power state is an off state.

34. A rotating device comprising:

(a) a rotatable body (b) a rotation sensor deployed inside said rotatable body, said rotation sensor being responsive to rotation of said rotatable body within the Earth's magnetic field to produce an output signal indicative of revolutions of said rotatable body relative to the Earth's magnetic field;

(c) a display disposed on said rotatable body; and (d) a controller configured to actuate said display so as to show content, said controller being responsive to said output signal so as to synchronize said display with rotation of said rotatable body such that said content appears substantially non-rotating as said rotatable body rotates, wherein said controller is configured to operate in at least a first mode wherein said content varies slightly between successive revolutions of said rotatable body to generate animated display content.

* * * * *